US006089607A

United States Patent [19]

Keeney et al.

[11] Patent Number: 6,089,607

[45] Date of Patent: Jul. 18, 2000

[54] CALENDAR AND APPOINTMENT JOURNAL

[75] Inventors: Michael Keeney; L. Roger Essen, both of Salt Lake City, Utah

[73] Assignee: Alliance Marketing Concepts, L.C., Salt Lake City, Utah

[21] Appl. No.: 09/163,503

[22] Filed: Sep. 30, 1998

Related U.S. Application Data

[60] Provisional application No. 60/060,635, Oct. 1, 1997.

[51] Int. Cl.[7] ..... B42D 1/00; B42D 15/00; B42F 13/30; B42F 21/00

[52] U.S. Cl. ..... 281/2; 281/3; 281/4; 402/79; 40/107

[58] Field of Search ..... 281/2, 3, 4; 402/79; 40/107

[56] References Cited

U.S. PATENT DOCUMENTS

| | | | |
|---|---|---|---|
| 1,574,838 | 3/1926 | Moore . | |
| 1,741,066 | 12/1929 | Morgan . | |
| 3,795,996 | 3/1974 | Hlavka | 40/107 |
| 4,345,394 | 8/1982 | Sullivan | 281/38 |
| 4,395,059 | 7/1983 | Rusell, III | 402/79 |
| 4,489,958 | 12/1984 | Martin | 283/48 |
| 4,516,871 | 5/1985 | Leitman | 402/79 |
| 4,669,754 | 6/1987 | Lalonde | 281/3 |
| 4,720,123 | 1/1988 | Chelius | 283/2 |
| 4,798,402 | 1/1989 | Pazicni | 283/2 |
| 4,858,350 | 8/1989 | Malarchik | 40/119 |
| 4,940,353 | 7/1990 | Osono et al. | 402/52 |
| 5,048,869 | 9/1991 | Schwartz | 281/16 |
| 5,240,340 | 8/1993 | Lynch et al. | 281/16 |
| 5,333,908 | 8/1994 | Dorney et al. | 283/38 |
| 5,339,546 | 8/1994 | Rahwan | 40/107 |
| 5,433,546 | 7/1995 | Kershaw . | |
| 5,538,135 | 7/1996 | Tremmel, Jr. | 281/31 |
| 5,590,911 | 1/1997 | Wilson | 283/36 |
| 5,697,647 | 12/1997 | Ruescas | 283/3 |
| 5,709,495 | 1/1998 | Brunner | 402/73 |
| 5,727,894 | 3/1998 | Covey | 402/79 |
| 5,797,630 | 8/1998 | Conley, Jr. | 283/54 |
| 5,806,894 | 9/1998 | Dottel | 281/38 |
| 5,836,711 | 11/1998 | Stewart | 402/79 |
| 5,915,873 | 6/1999 | Karlis | 402/79 |

*Primary Examiner*—Andrea L. Pitts
*Assistant Examiner*—Mark T. Henderson
*Attorney, Agent, or Firm*—Morriss, Bateman, O'Bryant & Compagni

[57] ABSTRACT

A calendaring and journal device is disclosed which is configured to enable the organized and compartmentalized recordation and annotation of appointments and notes within a structure which is designed to save paper while still giving an expanded capability for note-taking. The calendaring and journal device of the present invention is also structured to provide quick and easy access to the information annotated in any week and to enable the selective movement of information from one section to another without having to re-enter notes or information.

13 Claims, 10 Drawing Sheets

CALENDAR AND APPOINTMENT JOURNAL

CROSS-REFERENCE TO RELATED APPLICATION

This application claims the benefit of U.S. Provisional Application No. 60/060,635 filed Oct. 1, 1997.

BACKGROUND OF THE INVENTION

1. Field of the Invention

This invention relates to systems and methods for calendaring daily events and recording important information, and specifically relates to a system particularly structured to facilitate the access and use of such information and calendaring of events.

2. Description of Related Art

All typical "day planners" or appointment calendaring systems function in virtually an identical manner. That is, each two page spread, comprising left- and right-facing pages, contains one page which bears an area of pre-printed lines corresponding to hourly values (i.e. 8:00, 9:00, 10:00, etc.) and an opposing page which provides an area for noting different activities such as phone calls, tasks or things to-do, reservations, confirmations, records of events, expenses, notes and other information. This pattern or form layout is repeated for each day of the week or month and a monthly calender page typically divides the various months.

This conventional format creates several operational or functional problems. For example, because most "day planners" are structured to provide the ability to schedule and annotate the activities of a single day, and given the fact that there are 28–31 days in any given month, there is a tremendous amount of paper that comprises a single year of a day planner. As a result, most day planners, particularly those that are maintained in a spiral or three-ring binder form, can only be kept in increments or portions of the year, such as three or four months at a time. The amount of paper required to provide a daily planner also has the incidental disadvantage of limiting the space available in any day for making appointments or for annotating daily events or activities. That is, each day's page typically has only enough space for the appointments of that day, and should the user need to check his schedule for several days in advance, he must flip or turn from page to page and simultaneously try to retain each day's schedule in his memory.

Additionally, the conventional time slots (i.e., 9:00, 10:00, etc.) usually give disproportionate space to early morning or late night appointments and, thus, is not an accurate reflection of the time recorded or available in a given day. Each time slot entry must be reviewed carefully to assess available times during the day or evening. The right side page of most day planners provides but a single location for noting all information. Such annotated information usually encompasses a variety of different matters, including activities, reminders of things to-do and records. This mixing of unrelated information necessitated by the structural layout of typical day planners requires the user to employ complicated codes to label or separately identify these items. Because of the repeating nature of each page, any information or annotated activities that need to be addressed or completed on a following day must be rewritten onto the page of each subsequent day that the task remains unfinished. This constitutes nothing more than dated scratch paper.

The calender page or pages of typical planners never provide enough writing space on the needed day without overwriting the adjacent dates. Additionally, the shear mass of paper required to print typical planners in this format makes it impractical if not impossible to carry a full year of the planner at one time. That means that pages must be removed, stored and replaced periodically throughout the year.

Thus, it would be advantageous in the art to provide a planner device which is structured to provide flexible scheduling capabilities coupled with the structural means for facilitating access to information on any given day of a week, or subsequent weeks, and which reduces the amount of paper conventionally required to provide calendaring capabilities.

BRIEF SUMMARY OF THE INVENTION

In accordance with the present invention, a calendaring and journal device is configured to facilitate and simplify the daily scheduling of events and appointments and the annotation of reminders, tasks, addresses and other information, and is configured to facilitate access to such information. As a result of the configuration of the present calendaring and journal device, the amount of paper required to schedule and annotate such appointments and information is markedly reduced over known daily planners or calendars.

The calendaring and journal device of the present invention includes a paper-retaining member for retaining a plurality of paper sheets and includes a plurality of paper sheets especially configured for annotating and accessing information. The calendaring and journal device also includes a turn guide positionable between the paper sheets for facilitating ready access to the information annotated thereon. The paper-retaining member may be any suitable device which is capable of engaging a plurality of paper sheets while allowing the paper sheets to be selectively disengaged from the paper-retaining member for movement to another location within the arrangement of the paper sheets. One example of a paper-retaining member would be a ring binder of the type which provides selective engagement of paper sheets by rings that are movable from an open position to a closed position.

The paper sheets which form a part of the invention are classifiable into two or more types of paper sheets distinguishable by their differences in dimension. That is, a plurality of first-dimensioned paper sheets have a selected width and length dimension from which all other paper sheets vary in configuration and dimension. The first-dimensioned plurality of paper sheets includes a weekly scheduling page which is demarcated with annotation blocks within which can be written annotations corresponding to scheduled appointments or events for a given day and the annotation blocks are further divided into annotation sub-blocks corresponding to morning, day and evening times. The structural division of the annotation sub-blocks produces a graphic representation, or "snap shot," of annotated time commitments for the week so that the user evaluates visually what times or periods of time are available, rather than depending on viewing text. The plurality of first-dimensioned paper sheets also includes task pages which are imprinted with the current calendar month and are demarcated with one or more annotation blocks for annotating important information relating to scheduling of appointments, reminders, daily and weekly events and activities, etc. The present invention is designed to position a weekly scheduling page adjacent a task page, thereby providing a weekly "spread section." The weekly spread section is designed to provide space for annotating all information relating to a period of seven days. The two-page weekly spread, obviously, results in a reduction of paper over the use of a daily planner which often involves two pages of paper per day's scheduling.

The plurality of first-dimensioned paper sheets may also include note pages having one or more annotation blocks for use in making notes or annotations of any kind, such as lecture notes, and may include directions pages which are demarcated with columnar indicia for annotating names, addresses and phone numbers. The adjacent positioning of a task page and a directions page provides a second weekly "spread section" in which notes and addresses or directions for a given week may be annotated. Among the first-dimensioned paper sheets may also number additional pages, such as records pages, which may typically be positioned at the end of each monthly section and provides space for recording transactions, expenses, tax records and the like. The availability of additional specialized pages, such as the records pages, provides a segregation of information so that no single page contains a variety of unrelated information as is currently the case with present daily planners and calendars. Thus, information is more well organized and more easily accessed.

The present invention further includes a plurality of second-dimensioned paper sheets which are configured with a manipulable top margin for facilitating the movement of such second-dimensioned paper sheets relative to first-dimensioned paper sheets next to which the second-dimensioned paper sheets are positioned. The second-dimensioned paper sheets are also demarcated with one or more annotation blocks for entry of information and the second-dimensioned paper sheets serve as expansion sheets for providing additional space where information may be written. The second-dimensioned paper sheets are particularly configured to be readily manipulable and movable to another location in the consecutive arrangement of the first-dimensioned paper sheets to enable, for example, the advancement of information from one week to a subsequent week so that the information does not need to be rewritten into any subsequent day. This functional ability of the present invention renders the calendaring and journal device particularly advantageous because it reduces the amount of paper required to maintain notes and records.

A plurality of third-dimensioned paper sheets are configured with a manipulable side margin which also facilitates movement of third-dimensioned paper sheets relative to first-dimensioned paper sheets. While the third-dimensioned paper sheets may be inserted in either the first weekly spread section (i.e., between the weekly scheduling page and the adjacent task page) or the second weekly spread section, they are particularly useful when inserted in the latter because they are configured to expose to view the outer, lengthwise margin of the directions page, which may typically bear the indicia for annotation of phone numbers, and the third-dimensioned paper sheets thereby become effective at expanding the available writing space for making notes relating to a given name, address or phone number. For example, opposite a given number written on the underlying directions page, the user may note on the third-dimensioned page the dates and times during which the phone number was dialed and may indicate whether contact was made or not. The third-dimensioned paper sheets may be most suitably used to annotate phone numbers such that any notes of contacts not completed by the end of a given week can simply be advanced by taking the third-dimensioned paper sheet out of its present location and moving it to the next week, thereby eliminating the need to copy the phone numbers and messages over again in the next week. The same advantage of expanding the writing space of a given first-dimensioned paper sheet is provided by the third-dimensioned paper sheets.

The present invention may also include a plurality of fourth-dimensioned paper sheets which are particularly configured with a manipulable top margin and a manipulable side margin, thereby providing the advantages noted previously with respect to the second-dimensioned paper sheets and the third-dimensioned paper sheets. The invention may further include paper sheets of varying width dimension or length dimension (thereby constituting "n-dimensioned" paper sheets) such that, for example, a plurality of paper sheets each having a different width dimension can be positioned in consecutive order to each provide a manipulable side margin in cascading arrangement.

The calendaring and journal device of the present invention also includes a turn guide which is configured to provide easy access to information in different locations of calendaring device. By way of example, the turn guide may be positioned within the first weekly spread section and within the second weekly spread section to facilitate movement between those two sections which constitute the annotation capacity of one entire week. Alternatively, the turn guide may be positioned to facilitate movement between consecutive weeks, or between the first weeks of subsequent months, etc. Any number of combinations defined by the user may be used.

The turn guide is configured to engage at least two different sections of the calendaring and journal device as described. In one embodiment, for example, the turn guide may comprise a pair of planar locators which are structured to extend beyond the dimensions, length or width, of the first-dimensioned paper sheets to provide a graspable tab. For example, the first planar locator may be positioned in the first weekly spread section and the second planar locator may be positioned in the second weekly spread section and then the graspable tab of each planar locator may be grasped together to position therebetween an intervening paper sheet (i.e., the task page and note page) to quickly move from the first weekly spread section to the second weekly spread section. The planar locators may preferably be made of clear plastic material so that when positioned to overlie a paper sheet, the information written on the page sheet is visible therethrough. The planar locators may, however, be opaque. Any number or kind of helpful indicia may be printed on the planar locators, such as the twelve monthly calendars of the current year or two years.

In a second exemplar embodiment of the turn guide, the turn guide may be structured as a planar locator having a paper-engaging member, such as a flap, into which an amount or number of paper sheets may be temporarily retained so that a movement of the one planar locator enables quick movement between different sections of the calendaring and journal device. Many other designs and configurations of the turn guide may be employed.

BRIEF DESCRIPTION OF THE SEVERAL VIEWS OF THE DRAWINGS

In the drawings, which illustrate what is currently considered to be the best mode for carrying out the present invention.

DETAILED DESCRIPTION OF THE INVENTION

Figure 1:
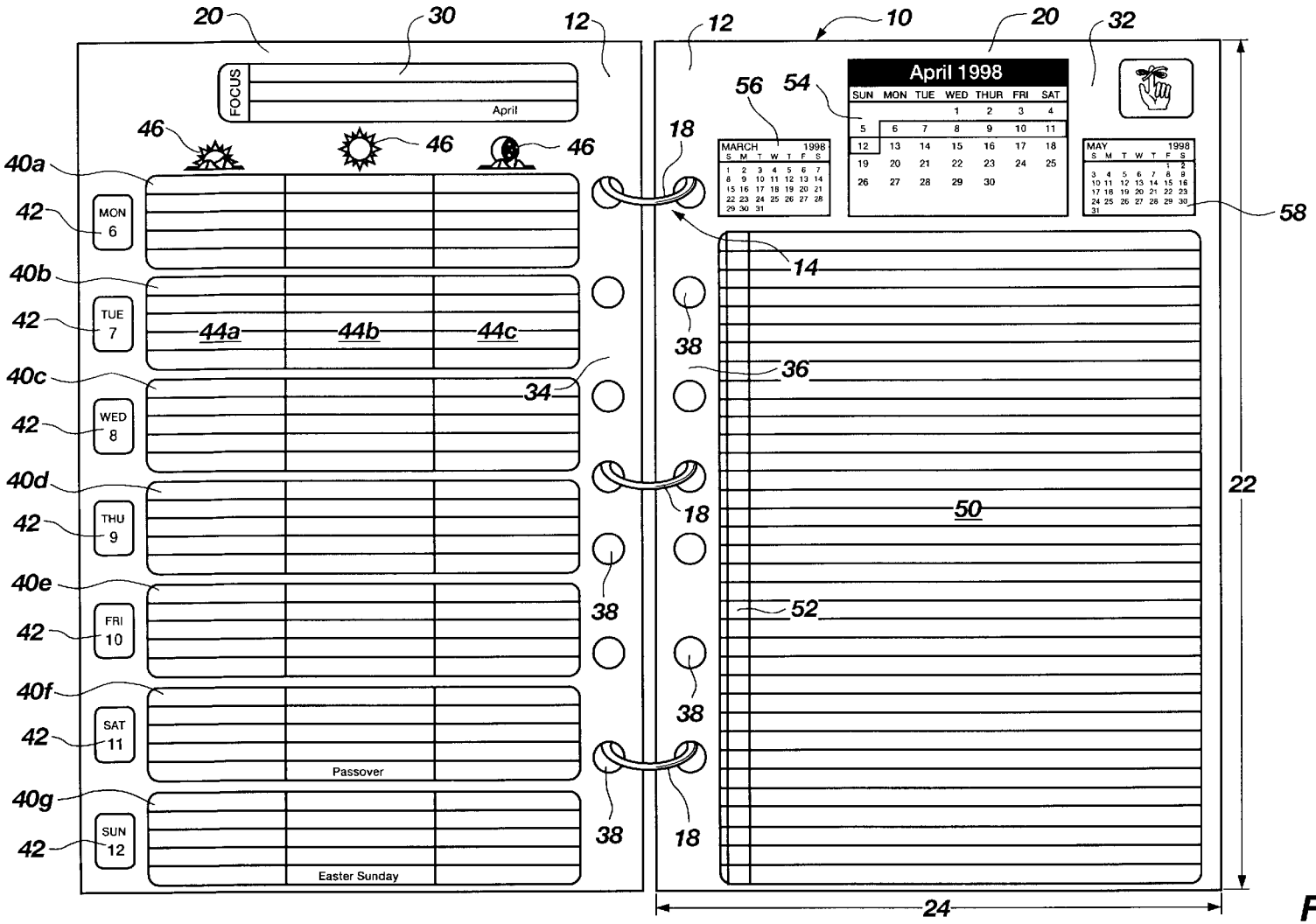
FIG. 1 is a view of a two-page weekly spread section of the present invention, comprising a weekly scheduling page positioned adjacent a task page.

As illustrated in FIG. 1, the calendaring and journal device 10 of the present invention generally comprises a plurality of paper sheets 12 upon which written annotations may be made corresponding to such matters as daily appointments, reminders, notes, records of daily events and activities, etc. The paper sheets 12 are maintained in a desired consecutive order as a result of being engaged by a paper-retaining member 14. The paper-retaining member 14 is structured to selectively engage the paper sheets 12 such that the paper sheets 12 may be disengaged from the paper-retaining member 14 for rearrangement in a different consecutive order. One example of a suitable paper-retaining member 14 would be a multiple-ringed binder of the type shown in FIG. 1 having a multiple number of rings 18 which can be opened and closed to alternatively engage and disengage the paper sheets 12 from the rings 18. Other equally suitable devices may be employed as the paper-retaining member 14.

The present invention includes a plurality of first-dimensioned paper sheets 20 which represent the bulk of the paper sheets 12 comprising the calendaring and journal device 10. The first-dimensioned paper sheets 20 have a selected length dimension 22 and a selected width dimension 24 against which all other paper sheets of different dimension are compared. The length and width dimensions of the first-dimensioned paper sheets 20 may be any desired measurement, and may range from large measurements (e.g., 14 inches by 10 inches, or larger), as may be used for a desk-top type calendaring device, to small measurements (e.g., 4 inches by 7 inches, or smaller) as may be used for a pocket-sized calendaring device.

The first-dimensioned paper sheets 20 include a weekly scheduling page 30 which typically is positioned in side-by-side adjacency to a task page 32, as shown, both pages being engaged by the paper-retaining member 14. As shown in FIG. 1, the first-dimensioned paper sheets 20 have a first edge 34, 36, respectively, structured to engage with the paper-retaining member 14. As illustrated, the first edge 34, 36 may be structured with a plurality of holes 38 for being retained by the rings 18 of the paper-retaining member 14. The arrangement of a weekly scheduling page 30 and an adjacent task page 32 may be considered to constitute a first weekly "spread section."

The weekly scheduling page 30 may be demarcated by seven annotation blocks 40*a*–40*g* in corresponding alignment with indicia 42 denoting the seven days of a given week. Each of the seven annotation blocks 40*a*–40*g* may also be divided into annotation sub-blocks, for example 44*a*, 44*b*, 44*c*, corresponding to morning, day and evening periods of the day. The weekly scheduling page 30 may be imprinted with indicia positioned to correspond with the annotation sub-blocks 44*a*, 44*b*, 44*c*. This arrangement of annotation blocks 40*a*–40*g* and sub-blocks 44*a*44*c* provides a significant amount of flexibility and ability to adapt the present invention to the schedule of any person, including those who work late at night or on a graveyard shift, for example.

The task page 32 is demarcated with at least one annotation block 50 in which annotations may be made, such as reminders of things to do or recordation of daily or weekly events or activities. A column 52 may be provided along one side of the annotation block 50 in which a check mark or other mark may be made to confirm to the user that a particular reminder or task was completed. The task page 32 may suitably be imprinted with the entire month's calendar 54 at the top of the task page 32 so that immediate reference can be made to it. It may also be desirable or helpful to provide the previous month's calendar 56 and the next month's calendar 58 in proximate arrangement with the current month's calendar 54.

Figure 2:
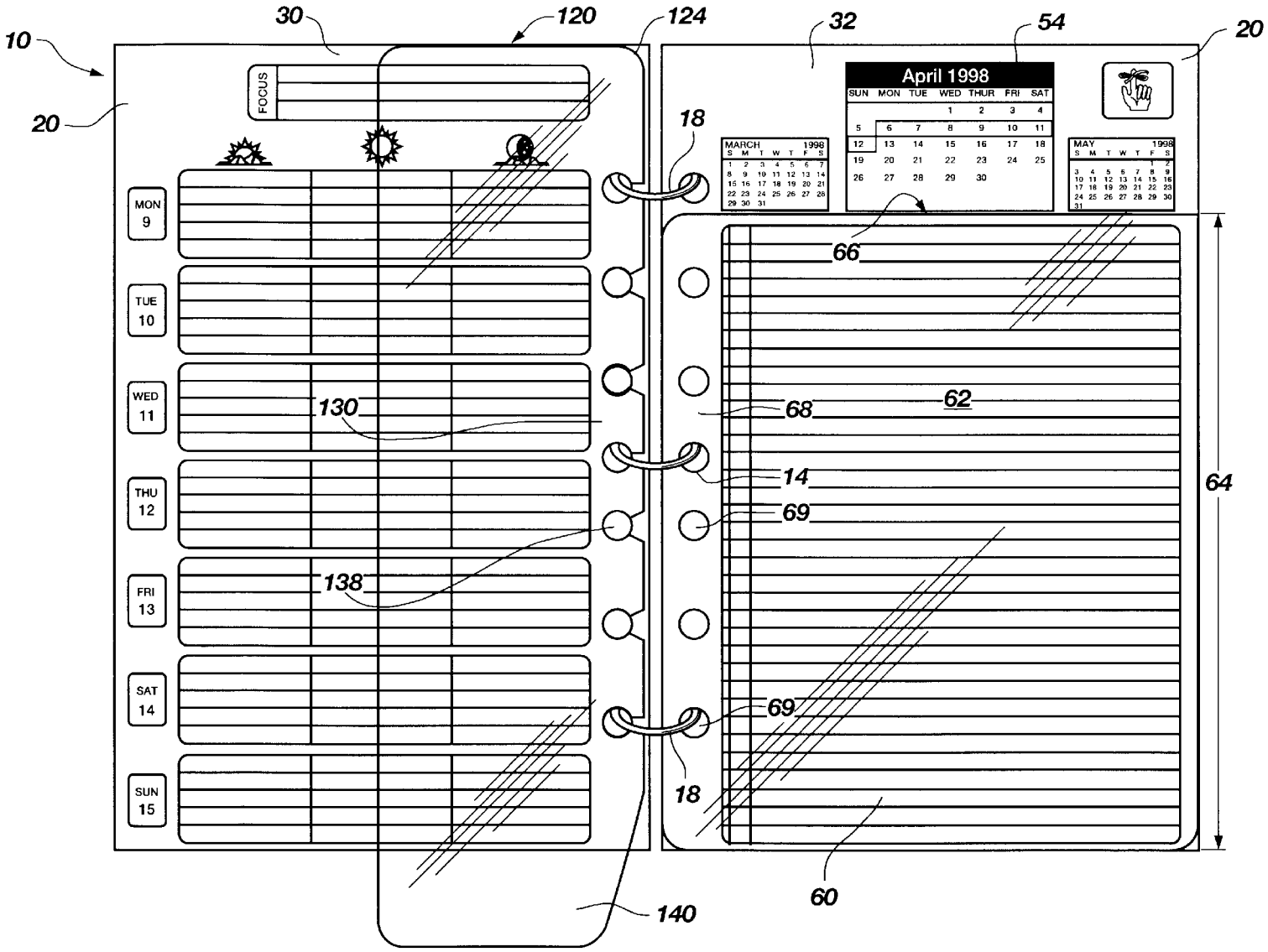
FIG. 2 is a view of the two-page weekly spread section shown in FIG. 1, further illustrating the relative positioning of a second-dimensioned paper sheet and a turn guide.
Figure 7:
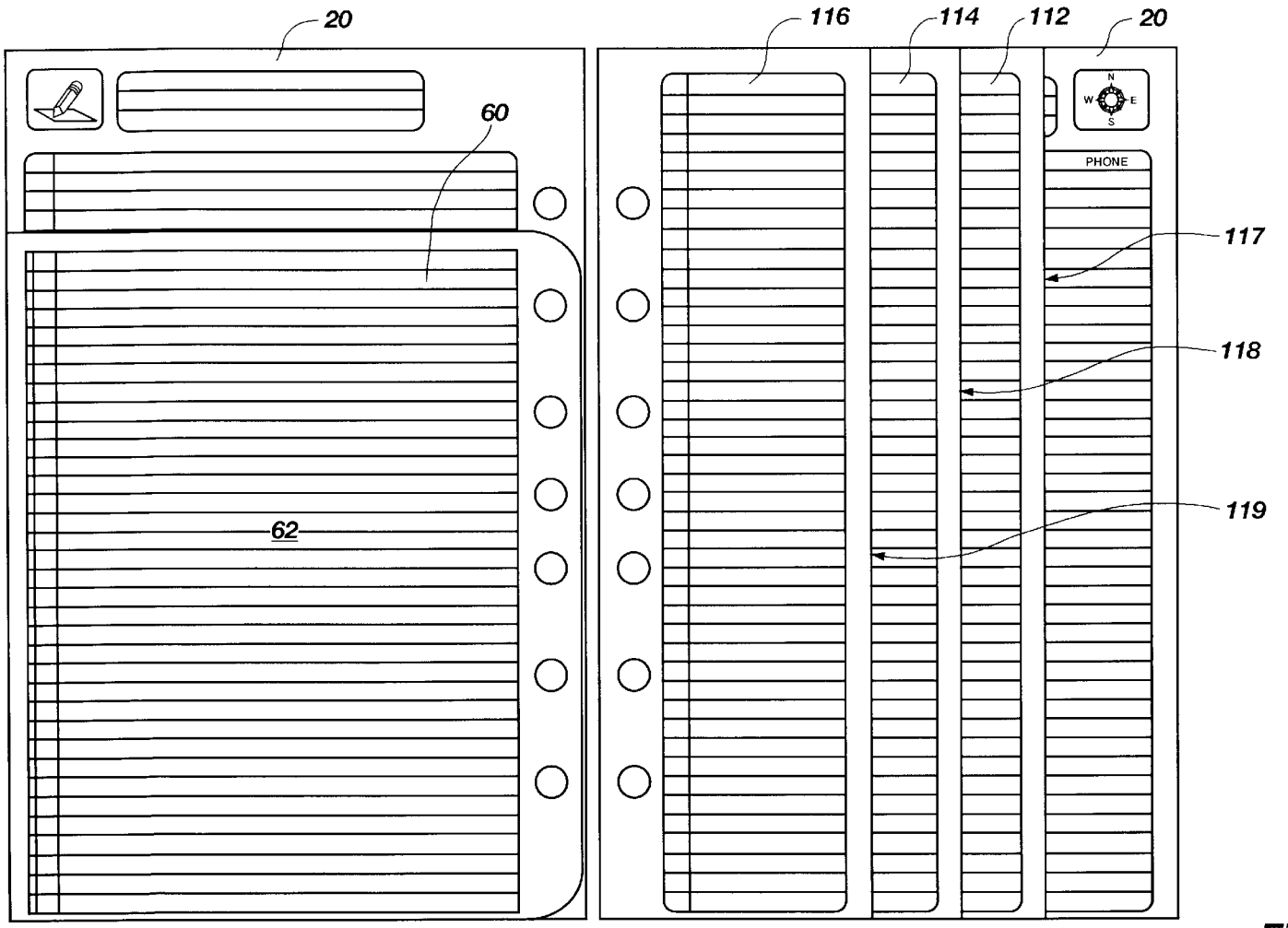
FIG. 7 is a view of the two-page second weekly spread section shown in FIG. 3 illustrating the relative positioning of a second-dimensioned paper sheet over the notes page.

A plurality of second-dimensioned paper sheets 60 are provided having at least one annotation block 62 for making annotations of appointments, records, and the like, as shown in FIG. 2. The second-dimensioned paper sheets 60 are provided for expanding the area on which annotations may be made, and may be positioned next to any first-dimensioned paper sheet 20 to serve as an expansion sheet. The second-dimensioned paper sheets 60 are typically configured with annotation blocks 62 on either side of the paper sheet 60, as shown in FIGS. 2 and 7. The second-dimensioned paper sheets 60 are sized with a length dimension 64 which is less than the length dimension 22 (FIG. 1) of the first-dimensioned paper sheets 20. Thus, the second-dimensioned paper sheets 60 are configured with a manipulable top margin 66 which enables the second-dimensioned paper sheet to be easily grasped and moved relative to the first-dimensioned paper sheet 20 which it overlies. As shown in FIG. 2, the second-dimensioned paper sheet 60 is suitable sized in length 64 to expose the calendar 54 imprinted on the task page 32, thereby providing easy reference to the monthly calendar while making notes and records on the second-dimensioned paper sheet 60. The second-dimensioned paper sheets 60 are notably configured along a first edge 68 with structure for being engaged by the paper-retaining member 14, such as, for example, the placement of a plurality of holes 69 for engagement with rings 18.

Figure 3:
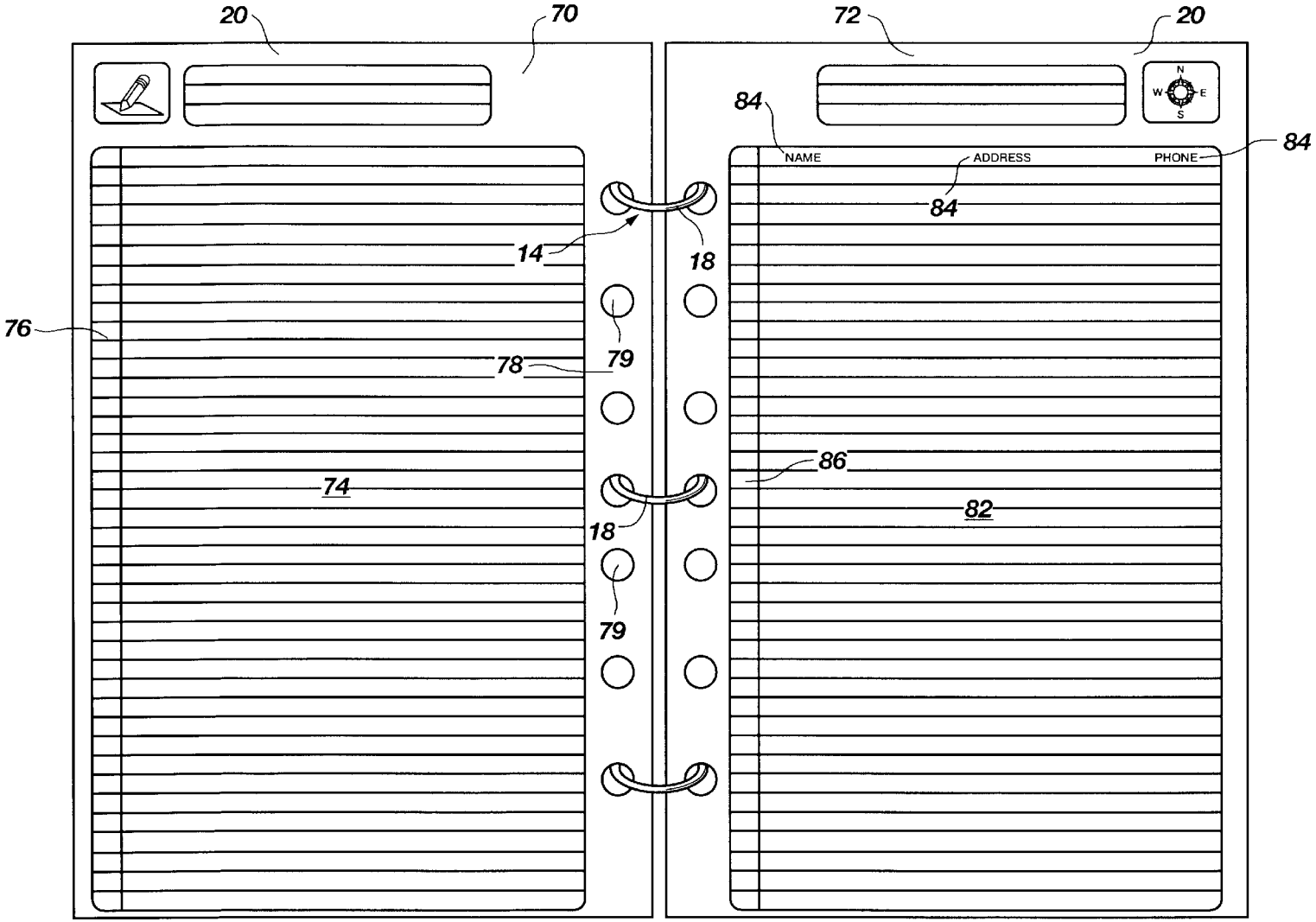
FIG. 3 is a view of a two-page second weekly spread section of the present invention, comprising a notes page positioned adjacent a task page.

The first-dimensioned paper sheets 20 of the present invention may also include, as shown in FIG. 3, a notes page 70 which is adjacently positionable next to a directions page 72 to form what may be termed a second weekly "spread section." Thus, in this embodiment of the invention, each week of a given month may comprise a first weekly spread section (comprising a weekly schedule page 30 and a task page 32), as shown in FIG. 1, and a second weekly spread section (comprising a notes page 70 and a directions page 72), as shown in FIG. 3. The first and second weekly spread sections provide a multitude of annotation blocks on which appointments, notes, reminders, addresses, and the like may be written while not only keeping such information conveniently compartmentalized for simplified reference, but maintaining the information in an easily accessed form, as described more fully hereinafter.

The notes page 70 is preferably demarcated with at least one annotation block 74 on which any variety of information may be recorded, as desired by the user. For example, the notes page may be particularly useful for annotating lecture notes or meeting notes so that they can be maintained separately from appointments and addresses, etc. A column 76 may be provided along one edge of the annotation block 74 for inserting a check mark or other completion indicia if the notes also contain information in the nature of reminders. The notes page 70 is structured with a first edge 78 configured for engagement by the paper-retaining member 14 and, as shown in one possible example, may be structured with holes 79 to be engaged by the rings of a paper-retaining member 14.

The directions page 72 is preferably demarcated with at least one annotation block 82 on which information relating to addresses or other directions may be written. For example, columnar indicia 84 may be provided to guide the recordation of names, addresses and phone numbers of persons whom the user needs to contact or visit in that particular week. A separate column 86 column may be provided along one edge of the annotation block 82 in which the user may place a check mark or other completion indicia confirming that the person was visited or contacted. The directions page 72 is configured with a first edge 88 structured to be retained by the paper-retaining member 14 of the invention. As shown, the directions page 72 may be structured with a plurality of holes 89 for engagement with, for example, the rings of a paper-retaining member 14.

Figure 4:
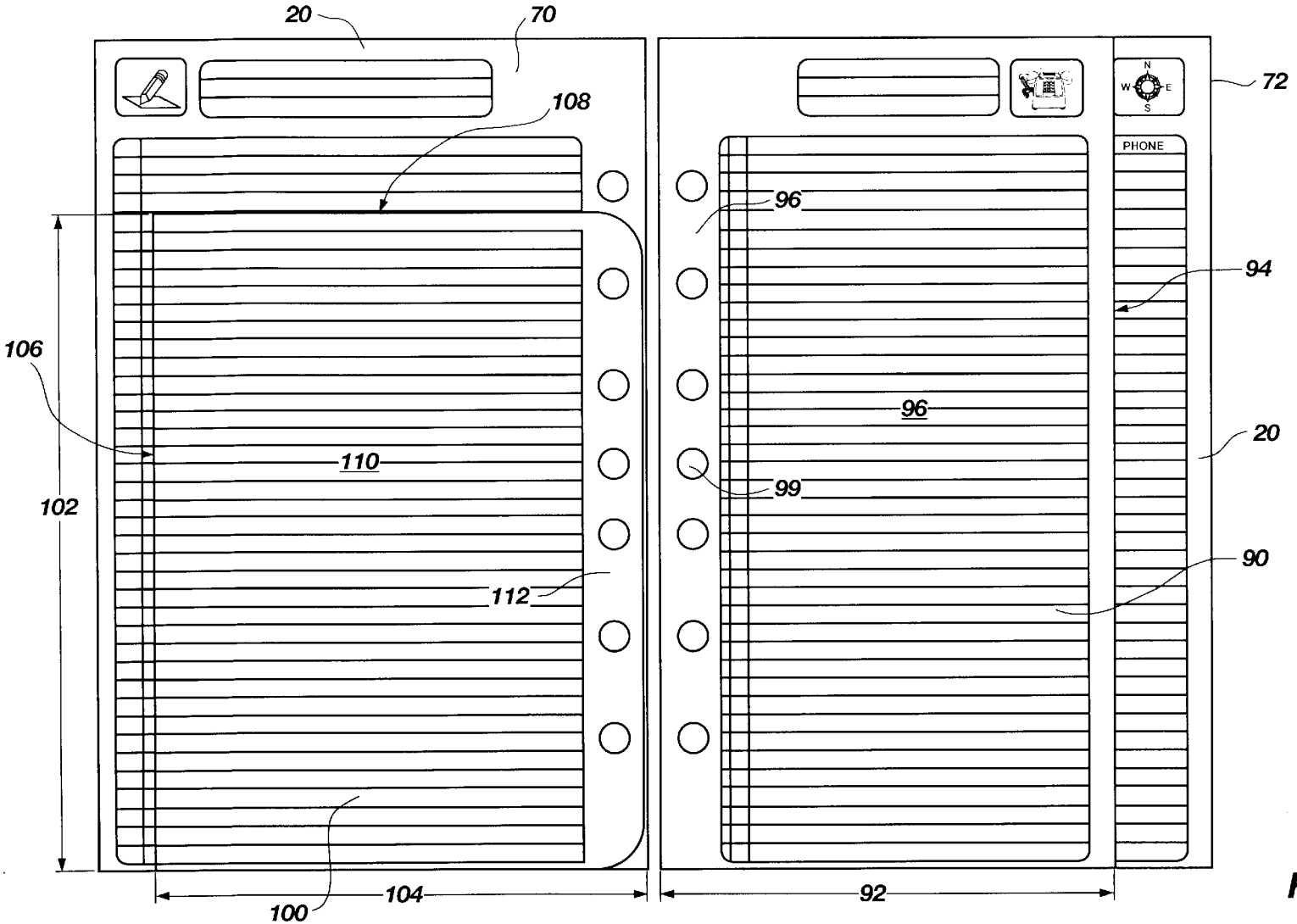
FIG. 4 is a view of the two-page second weekly spread section shown in FIG. 3 illustrating the relative positioning of a third-dimensioned paper sheet and a fourth-dimensioned paper sheet.

As shown in FIG. 4, the present invention includes a plurality of third-dimensioned paper sheets 90 for positioning between first-dimensioned paper sheets 20 to provide additional space for annotating information, thereby expanding the note-taking capabilities of the invention. The third-dimensioned paper sheets 90 are configured with a width dimension 92 which is less than the width dimension 24 (FIG. 1) of the first-dimensioned paper sheets 20. Thus, the third-dimensioned paper sheets 90 are configured with a manipulable side margin 94 which enables the third-dimensioned paper sheet 90 to be easily moved relative to the first-dimensioned paper sheet 20 in proximity to which the third-dimensioned paper sheet 90 is positioned. Further, as shown in FIG. 4, the third-dimensioned paper sheet 92 is sized to expose a portion of the underlying first-dimensioned paper sheet 20, here shown as the outer demarcated phone column of the directions page 72.

The third-dimensioned paper sheets 90 are preferably configured with at least one annotation block 96 on which notes may be written. The third-dimensioned paper sheets 90 may be positioned at any desired place within the first weekly spread section or the second weekly spread section (FIG. 4), but the particular advantage of the third-dimensioned paper sheet 92 may be realized in FIG. 4 where it can be seen that notes relating to a particular phone number annotated on the directions page 72 may be made on the third-dimensioned paper sheet 90. That is, for example, if a phone number written on the directions page 72 needs to be called, the user may note on the third-dimensioned paper sheet 90, across from the phone number, the dates and times on which the number was called. Further, if contact with the person at that number cannot be made within a given week's time, the third-dimensioned paper sheet 90 can simply be removed from its current placement and advanced to the next weeks section, thereby eliminating the need to re-enter or re-annotate the phone number or the efforts made to make contact. Accordingly, the need to keep flipping back and forth between several intervening days to remember what took place with respect to that number several days ago is eliminated. The third-dimensioned paper sheet 90 is configured with a first edge 98 structured to be selectively engaged by the paper-retaining member 14 (not shown in FIG. 4) and, for example, may have a plurality of holes 99 positioned to be engaged by the rings 18 (not shown) of a paper-retaining device 14.

Figure 5:
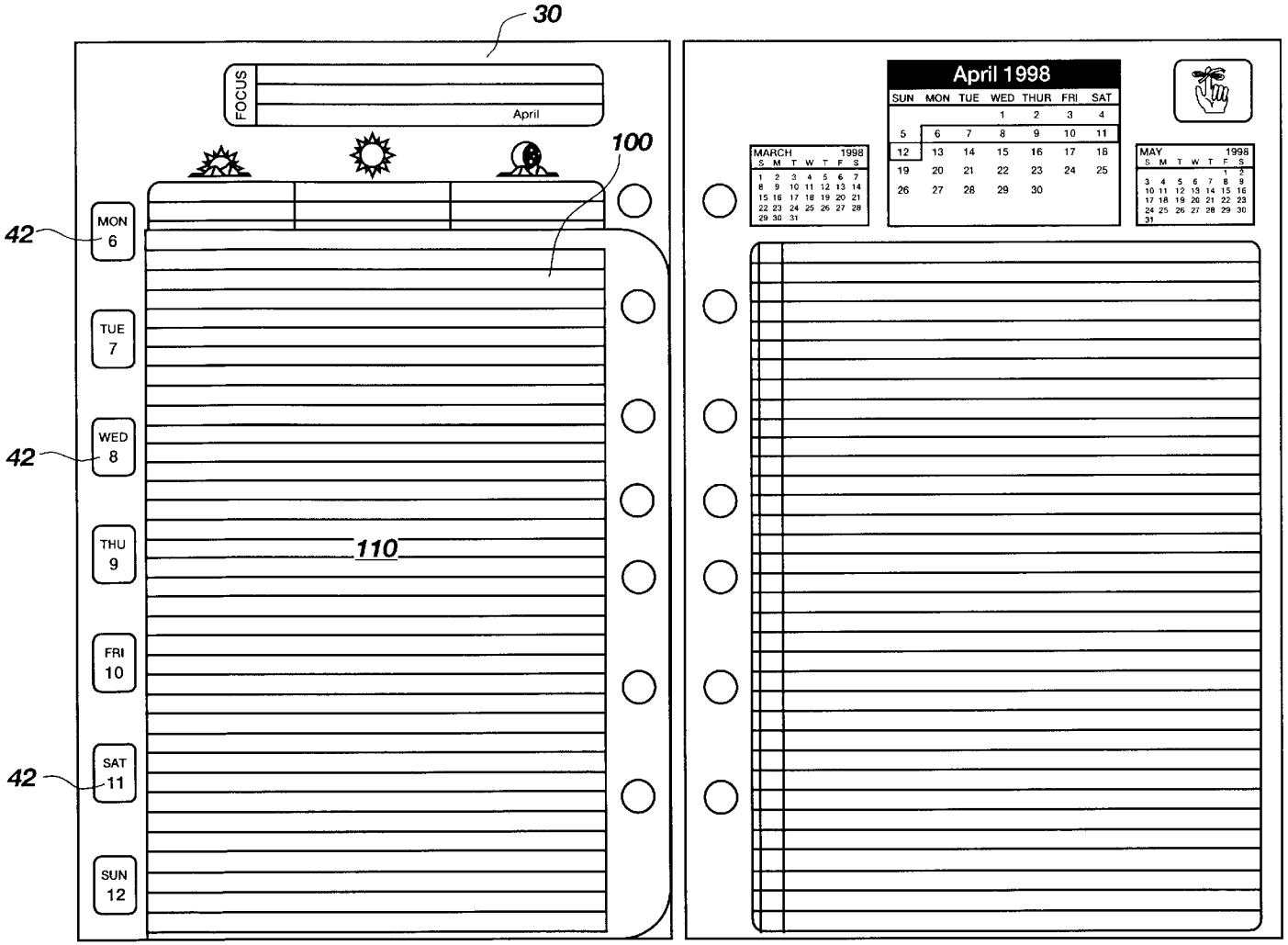
FIG. 5 is a view of the two-page weekly spread section shown in FIG. 1 illustrating the relative positioning of a fourth-dimensioned paper sheet over the weekly scheduling page.

The present invention may also include a plurality of fourth-dimensioned paper sheets 100, as shown in FIG. 4, which are sized to have a length dimension 102 which is less than the length dimension 22 (FIG. 1) of the first-dimensioned paper sheets 20 and a width dimension 104 which is less than the width dimension 24 (FIG. 1) of the first-dimensioned paper sheets 20. Thus, the fourth-dimensioned paper sheets 100 are configured with both a manipulable top margin 108 and a manipulable side margin 106 which not only facilitates the movement of the fourth-dimensioned paper sheets 100 in the manner previously described, but also renders them advantageously configured to expose certain portions of the underlying first-dimensioned paper sheet 20 to enhance note-taking capabilities on the annotation block 110 of the fourth-dimensioned paper sheets 100. For example, as shown in FIG. 5, the fourth-dimensioned paper sheets 100 may be positioned over the weekly scheduling page 30 so that the indicia 42 corresponding to the days of the week are exposed, thereby enabling the annotation block 110 of the fourth-dimensioned paper sheet 100 to serve as an expansion page for recording appointments and daily or weekly events. Similar to the second-dimensioned paper sheets 60 and third-dimensioned paper sheets 90, the fourth-dimensioned paper sheets 100 may simply be removed from the paper-retaining member 14 (FIG. 1) and repositioned to another weekly section so that, for example, any appointments not realized in a previous week can be instantaneously rescheduled to a subsequent week simply by moving a paper sheet, and thereby avoiding the need to re-enter the relevant information relating to the appointment. As shown in FIG. 4, the fourth-dimensioned paper sheets 100 are configured with a first edge 112 structured to be selectively engaged by the paper-retaining member 14 (FIG. 1).

Figure 6:
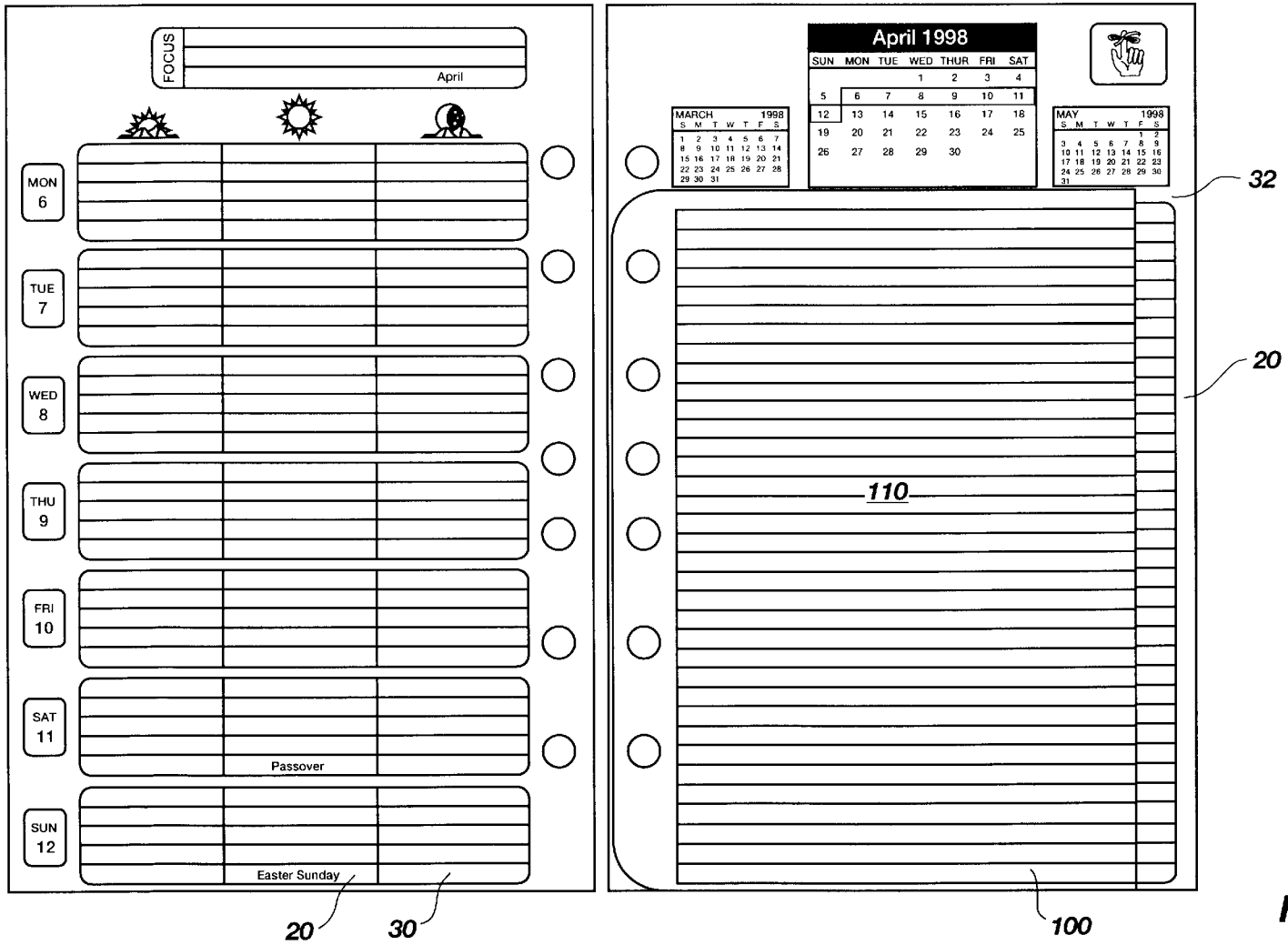
FIG. 6 is a view of the two-page weekly spread section shown in FIG. 1 illustrating the relative positioning of a fourth-dimensioned paper sheet over the task page.

FIGS. 5 and 6 illustrate in tandem that the fourth-dimensioned paper sheets 100 are imprinted on both sides thereof with annotation blocks 110 so that one paper sheet 100 may be employed to expand the note-taking capabilities of the two adjacently positioned first-dimensioned paper sheets 20 in both the first weekly spread section and the second weekly spread section. FIG. 7 similarly demonstrates that the second-dimensioned paper sheets 60 are imprinted on both sides with annotation blocks 62 to expand the note-taking capabilities of the two adjacently positioned first-dimensioned paper sheets 20 in both the first weekly spread section or the second weekly spread section, as shown in FIG. 7. Similarly, the third-dimensioned paper sheets 90 are imprinted on both sides with annotation blocks 92 that similarly enhance expanded note-taking capabilities wherever the third-dimensioned paper sheets 90 may be placed.

FIG. 7 also illustrates that paper sheets of varying width (or, alternatively, varying length (not shown)) can be employed to expand the annotation capabilities of the invention. That is, paper sheets 112, 114, 116, each having a slightly smaller width dimension, can be positioned in consecutive order to provide a manipulable side margin, 117, 118, 119, respectively. The paper sheets 112, 114, 116 can thus be positioned in a cascading arrangement to provide additional annotation spaces in an easily accessed manner. Notably, a similar arrangement can be made of paper sheets of varying length dimension each providing a manipulable top margin in cascading arrangement.

Figure 8:
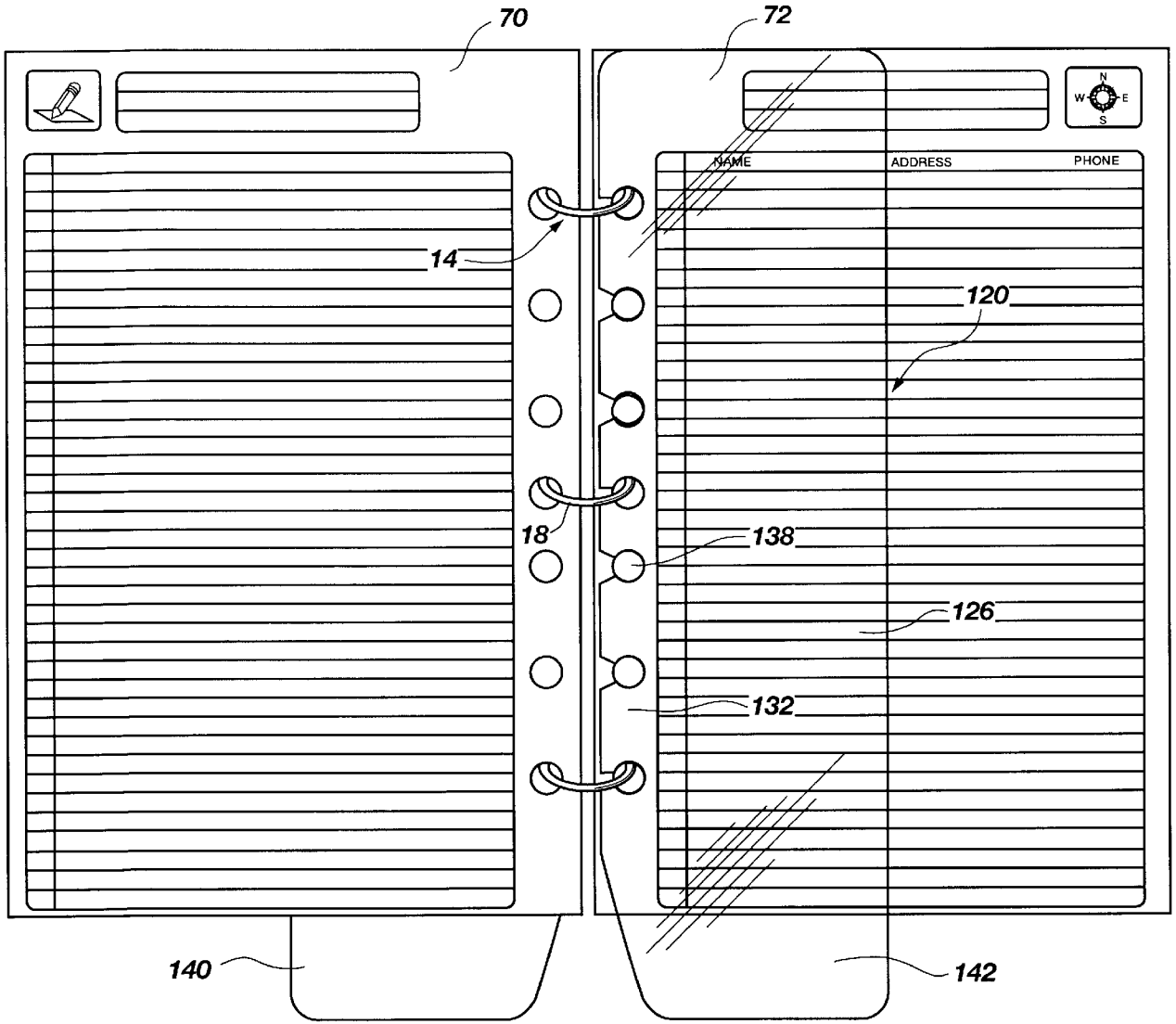
FIG. 8 is a view of the two-page second weekly spread section shown in FIG. 3, further illustrating one embodiment of the turn guide.

Referring jointly to FIGS. 2 and 8, it can be seen that the present invention includes a turn guide 120 which enables the user to move quickly between any two selected sections of locations of the calendaring and journal device 10. The turn guide 120 generally is configured to engage a number of paper sheets in a manner that enables the engaged paper sheets to be moved relative to the paper-retaining member 14. One exemplar embodiment of the turn guide 120 is shown in FIGS. 2 and 8 where the turn guide 120 comprises a first planar locator 124, which is positioned, for example, in the first weekly spread section (i.e., between the weekly scheduling page 30 and the task page 32), and a second planar locator 126 (FIG. 8), which is positioned in the second weekly spread section (i.e., between the notes page 70 and the directions page 72). The first planar locator 124 and second planar locator 126 may each be suitably structured with an edge 130, 132 which engages with the paper-retaining member 14 of the invention, such as being configured with a plurality of holes 136, 138 which are sized and positioned to engage the rings 18 of a paper-retaining member 14 as shown in FIGS. 2 and 8.

Figure 9:
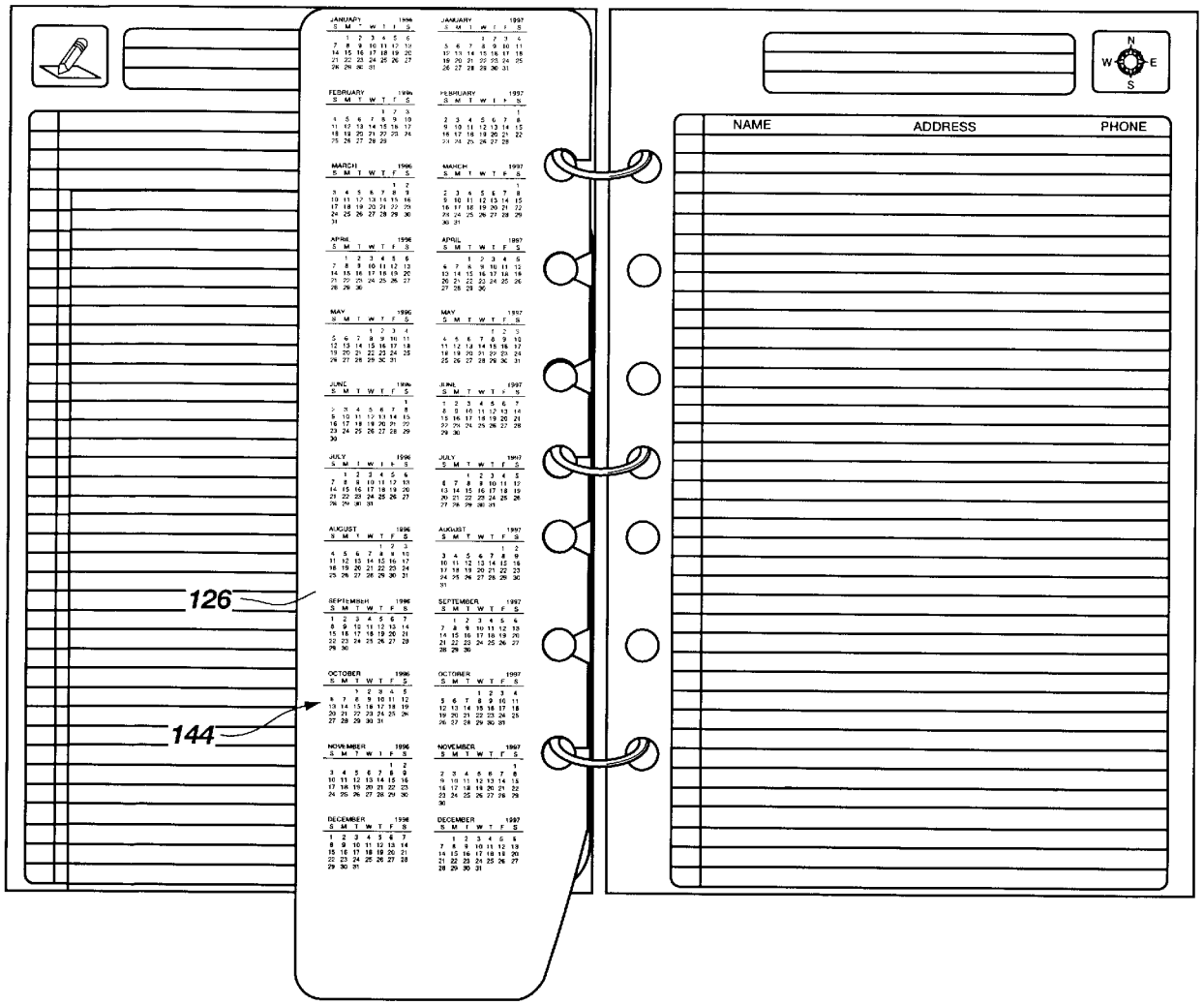
FIG. 9 is a view of an alternative configuration of a planar locator of the turn guide.

The first planar locator 124 is structured in dimension to extend beyond the dimension of the first-dimensioned paper sheets 20, such as being longer in length than the length dimension 22 of the first-dimensioned paper sheets 20, to provide a graspable tab 140 for turning the first planar locator 124 and the paper sheets which are positioned on either side of first planar locator 124 in the direction of the turn. The second planar locator 126 is similarly structured in dimension to extend beyond the dimension of the first-dimensioned paper sheets 20, such as being longer in length than the length dimension 22 of the first-dimensioned paper sheets 20, to provide a graspable tab 142 for turning the second planar locator 126 and the paper sheets which are positioned on either side of the second planar locator in the direction opposite the turn. As shown in FIG. 8, the graspable tab 140 of the first planar locator 124 is positioned to be easily grasped with the graspable tab 142 of the second planar locator 126 to facilitate a one-handed turning of a group of paper sheets. As further noted in FIGS. 2 and 8, the first planar locator 124 and the second planar locator 126 may be made of a transparent material, such as plastic, so that the information annotated on the underlying paper sheet (e.g., first-dimensioned paper sheet 20 or second-dimensioned paper sheet 60, etc.) can be viewed. Alternatively, as shown in FIG. 9, one or both of the planar locators 124, 126 may be made of an opaque material, such as plastic, and may be imprinted with any variety of indicia. A particularly suitable imprint 144 may be, as shown, the twelve months of the current year and the next calendar year so that easy reference can be made to the entire year (and next year) without flipping to the front or the back of the calendaring device as is necessary with conventional day planners.

Figure 10:
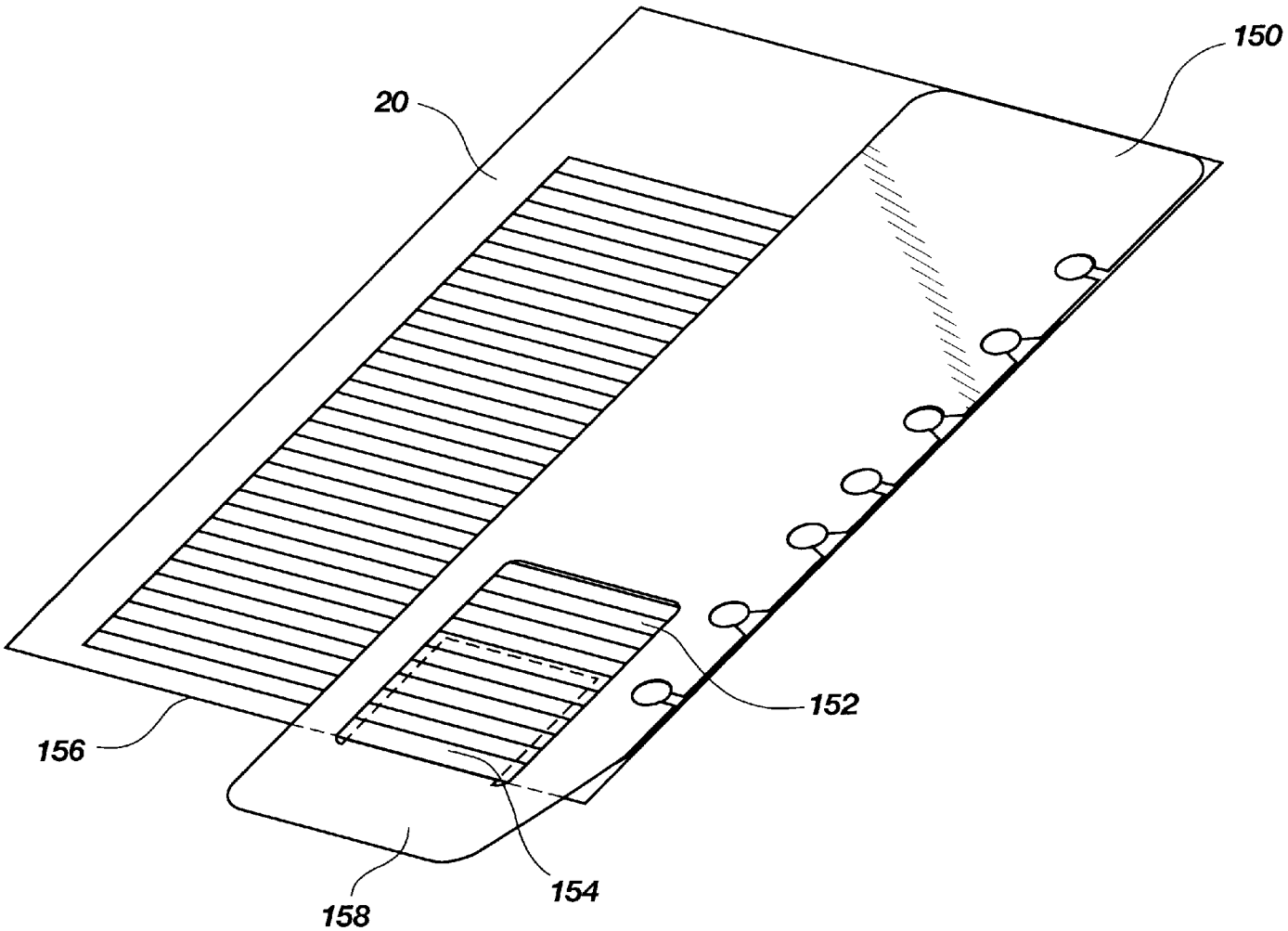
FIG. 10 is a perspective view of an alternative embodiment of the turn guide.

An alternative embodiment of the turn guide 120 is shown in FIG. 10 where a planar locator 150 is configured to have clip portion 152 having a tongue 154 which can be manipulated to engage the bottom edge 156 of a paper sheet, such as the bottom edge 156 of a first-dimensioned paper sheet 20, as shown. In fact, several paper sheets may be engaged by the tongue 154 of the planar locator 150 to flip between selected sections of the calendaring and journal device.

The calendaring and journal device of the present invention is particularly configured to enable the organized and compartmentalized recordation and annotation of appointments and notes within a structure which is designed to save paper while still giving an expanded capability for note-taking. The calendaring and journal device of the present invention is also structured to provide quick and easy access to the information annotated in any week and to enable the selective movement of information from one section to another without having to re-enter notes or information. The device of the present invention can be adapted to any number of calendaring or journal uses. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. A calendaring and journal device comprising:

a paper-retaining member configured to engage a plurality of paper sheets in consecutive arrangement, said paper retaining member being adjustable to disengage a number of paper sheets therefrom;

a plurality of first-dimensioned paper sheets, each having a first edge structured to be engaged by said paper-retaining member and each said first-dimensioned paper sheet having a selected length dimension and a selected width dimension, said plurality of first-dimensioned paper sheets further comprising:

at least one weekly scheduling page demarcated with annotation blocks corresponding to the seven days of the week and being positioned in alignment with an imprinted indica of a day of the week, each said annotation block also being demarcated to provide annotation sub-blocks corresponding to morning, afternoon and evening divisions of each day; and at least one task page for positioning next to said at least one weekly scheduling page to provide a first weekly spread section, each said at least one task page having a top being imprinted with a current calendar month;

a plurality of second-dimensioned paper sheets positionable between said first-dimensioned paper sheets and each having a first edge structured to be engaged by said paper-retaining member, each said second-dimensioned paper sheet having a length dimension which is less than said selected length dimension of said first-dimensioned paper sheets thereby providing a manipulable top margin;

A plurality of third-dimensioned paper sheets positionable between said first-dimensioned paper sheets and each having a first edge structured to be engaged by said paper-retaining member, each said third-dimensioned paper sheet having a width dimension which is less than said selected width dimension of said first-dimensioned paper sheets thereby providing a manipulable side margin; and a turn guide comprising two planar locator members selectively positionable between one or more consecutively-arranged paper sheets to enable a simultaneous movement of said consecutively-arranged paper sheets, said turn guide being sized to extend beyond one said dimension of said first-dimensioned paper sheets to provide a graspable member facilitating manipulation of said turn guide.

2. The calendaring and journal device of claim 1 wherein said two planar locator members are configured to be selectively engaged by said paper-retaining guide.

3. The calendaring and journal device of claim 1 wherein at least one of said two planar locator members is configured with clipping apparatus for engaging a number of paper sheets.

4. The calendaring and journal device of claim 1 wherein said plurality of first-dimensioned paper sheets further comprises at least one notes page and at least one directions page, said at least one notes page and adjacently-positioned at least one directions page providing a second section of said weekly spread section.

5. The calendaring and journal device of claim 1 further comprising a plurality of fourth-dimensioned paper sheets wherein said width dimension of said fourth-dimensioned paper sheets is less than said width dimension of said first-dimensioned paper sheets to thereby provide a manipulable side margin and wherein said length dimension of said fourth-dimensioned paper sheets is less than said length dimension of said first-dimensioned paper sheets to thereby provide a manipulable top margin, said manipulable side margin being configured to expose to view said imprinted indicia of said weekly scheduling pages when said fourth-dimensioned paper sheets are positioned to overlay said weekly scheduling pages.

6. The calendaring and journal device of claim 2 wherein at least one of said two planar locator members is imprinted with reference indicia corresponding to the twelve months of a calendar year.

7. The calendaring and journal device of claim 2 wherein at least one of said two planar locator members is transparent to enable viewing of said first-dimensioned paper sheets therethrough.

8. The calendaring and journal device of claim 4 wherein said at least one directions page is imprinted with columnar indicia corresponding to names, addresses and phone numbers, and further wherein said manipulable side margin of said third-dimensioned paper sheets exposes the columnar indicia of phone numbers when positioned over said at least one directions page.

9. The calendaring and journal device of claim 8 wherein one said planar locator member is positioned in a said first weekly spread section and another said planar locator member is positioned in a second section of said weekly spread section, and further wherein each of said two planar locator members is configured with a graspable member to facilitate the simultaneous grasping of each said planar locator member.

10. The calendaring and journal device of claim 9 wherein said two planar locator members are configured to be selectively engaged by said paper-retaining guide.

11. The calendaring and journal device of claim 9 wherein at least one of said two planar locator members is configured with clipping apparatus for engaging a number of paper sheets.

12. The calendaring and journal device of claim 10 wherein at least one of said two planar locator members is imprinted with reference indicia corresponding to the twelve months of a calendar year.

13. The calendaring and journal device of claim 10 wherein at least one of said two planar locator members is transparent to enable viewing of said first-dimensioned paper sheets therethrough.

* * * * *